US005445133A

United States Patent [19]

Nemoto

[11] Patent Number: 5,445,133

[45] Date of Patent: Aug. 29, 1995

[54] CANISTER PURGE GAS CONTROL DEVICE AND CONTROL METHOD FOR INTERNAL COMBUSTION ENGINE

[75] Inventor: Mamoru Nemoto, Hitachinaka, Japan

[73] Assignees: Hitachi, Ltd., Tokyo; Hitachi Automotive Engineering Co., Ltd., Ibaraki, both of Japan

[21] Appl. No.: 347,085

[22] Filed: Nov. 23, 1994

[30] Foreign Application Priority Data

Nov. 26, 1993 [JP] Japan ..... 5-296975

[51] Int. Cl.[6] ..... F02M 33/02

[52] U.S. Cl. ..... 123/520; 123/198 D

[58] Field of Search ..... 123/520, 519, 518, 516, 123/198 D, 521, 357

[56] References Cited

U.S. PATENT DOCUMENTS

| | | | |
|---|---|---|---|
| 4,977,881 | 12/1990 | Abe | 123/520 |
| 5,048,493 | 9/1991 | Orzel | 123/520 |
| 5,215,061 | 6/1993 | Ogawa | 123/520 |
| 5,251,592 | 10/1993 | Seki | 123/520 |
| 5,299,546 | 4/1994 | Kato | 123/520 |
| 5,343,846 | 9/1994 | Ogawa | 123/520 |
| 5,355,862 | 10/1994 | Muramatsu | 123/520 |
| 5,359,980 | 11/1994 | Tomisawa | 123/520 |
| 5,363,832 | 11/1994 | Suzumura | 123/520 |
| 5,373,822 | 12/1994 | Thompson | 123/520 |
| 5,390,644 | 2/1995 | Numogaki | 123/520 |

FOREIGN PATENT DOCUMENTS 63-129159 6/1988 Japan .

*Primary Examiner*—Carl S. Miller

*Attorney, Agent, or Firm*—Evenson, McKeown, Edwards & Lenahan

[57] ABSTRACT

A fuel injection control device for an internal combustion engine includes a canister which temporarily collects fuel vapor purge gas generated in a fuel tank and a canister purge gas control system which introduces the collected fuel vapor purge gas into the internal combustion engine during the operation thereof. The canister purge gas control system includes a purge gas air/fuel ratio calculating system which determines the purge gas air/fuel ratio of the collected fuel vapor purge gas to be introduced into the combustion engine, and only during a time when the purge gas air/fuel ratio calculated by the purge gas air/fuel ratio calculating system is within a predetermined range, the canister purge gas control system interrupts the introduction of the collected fuel vapor purge gas into the internal combustion engine so as to permit an air/fuel ratio learning control system to perform an air/fuel ratio learning control, whereby an air/fuel ratio learning control is performed without causing an air/fuel ratio variation and an output power variation of the internal combustion engine.

5 Claims, 9 Drawing Sheets

30

CANISTER PURGE GAS CONTROL DEVICE AND CONTROL METHOD FOR INTERNAL COMBUSTION ENGINE

BACKGROUND OF THE INVENTION

1. Field of the Invention

The present invention relates to a canister purge gas control device and control method for an internal combustion engine and, more specifically relates to an air/fuel ratio learning control for an internal combustion engine with a fuel evaporation collecting device for when the collected fuel is introduced into the engine.

2. Description of Related Art

In one well known conventional air/fuel ratio learning control, where the collected fuel is introduced into the engine the air/fuel ratio learning control is performed after temporarily interrupting the introduction of the purge gas as disclosed in JP-A-63-129159(1988).

However, when the introduction of the purge gas containing a large amount of fuel component is interrupted, the ratio of air and fuel which are supplied to the engine suddenly changes, which causes problems such as the exhausting of harmful gases and the variation of output power.

SUMMARY OF THE INVENTION

An object of the present invention is to provide a canister purge gas control device and control method for an internal combustion engine which prevents such problems as the harmful gas exhausting and the output power variation when performing air/fuel ratio learning control while interrupting the purge gas introduction into the engine.

For achieving the above object, the present invention is characterized in that, the air/fuel ratio learning control is performed while interrupting the introduction of a purge gas after calculating a purge gas air/fuel ratio based on a purge gas containing rate and an air/fuel ratio feed back correction amount. It is ascertained that the calculated purge gas air/fuel ratio is within a predetermined range.

Namely, when the purge gas air/fuel ratio shows a rich condition which represents that the purge gas contains a large amount of fuel component, the air/fuel ratio learning control is prevented.

When the purge gas air/fuel ratio shows a value near the stoichiometric air/fuel ratio, the introduction of the purge gas is temporarily interrupted, and the air/fuel ratio learning control is performed. At this moment, since the purge gas air/fuel ratio is near the stoichiometric air/fuel ratio, no output variation of the internal combustion engine is caused even if the introduction of the purge gas is suddenly interrupted.

DETAILED DESCRIPTION OF THE EMBODIMENT

Hereinbelow an electronic control fuel injection device including a canister purge gas control device according to the present invention is explained.

Figure 1:
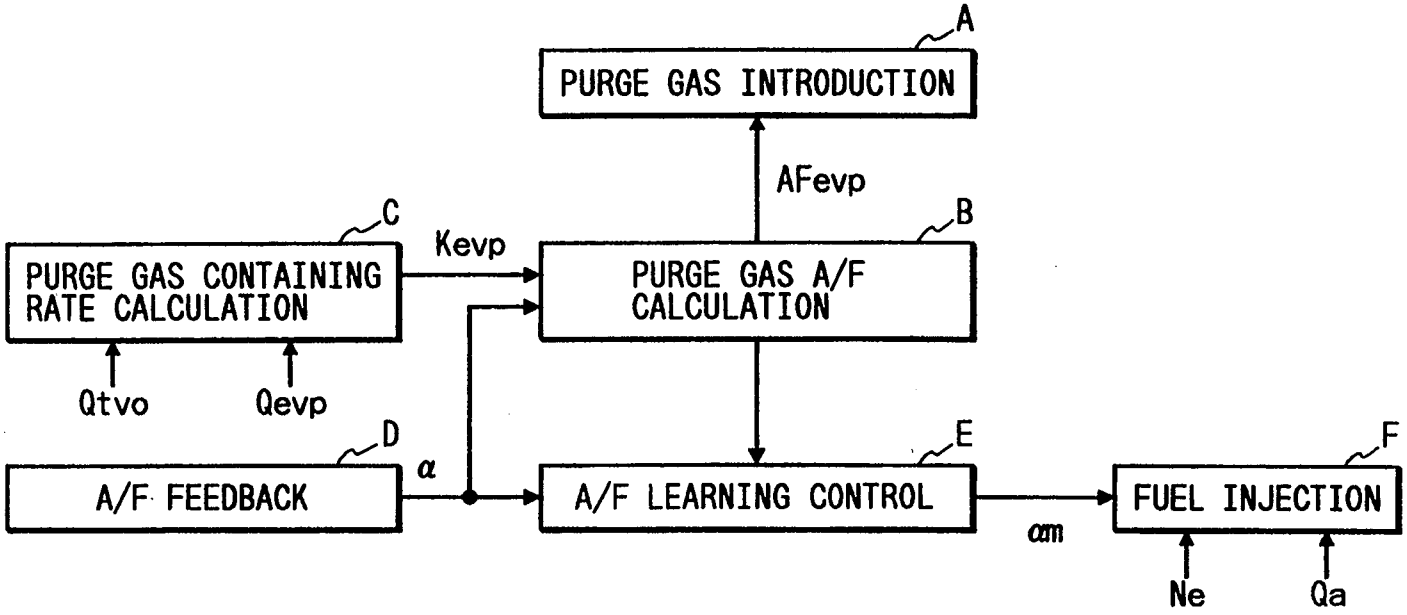
FIG. 1 is a block diagram of one embodiment of canister purge gas control devices in an electronic control fuel injection device for an internal combustion engine according to the present invention.

FIG. 1 is a block diagram illustrating one example of the construction of the systems according to the present invention, wherein A represents a collected fuel introducing systems which introduces the collected fuel into an engine through control of a purge gas air/fuel ratio calculating systems B. The purge gas air/fuel ratio calculating systems B performs an estimation of a purge gas air/fuel ratio AFevp depending on a purge gas containing rate determined by a purge gas containing rate calculating system C and an $O_2$ feed back coefficient a calculated based on an output from an air/fuel ratio feeding back system D. The purge gas containing rate calculating systems C determines a purge gas containing rate Kevp depending on an air flow rate Qtvo passing through the throttle valve and a canister purge gas containing rate Qevp. Reference E represents an air/fuel ratio learning system which performs a calculation of a learning correction coefficient $\alpha$m. F represents a fuel injection means which calculates a fuel injection time based on parameters such as an engine rpm Ne, an intake air flow rate Qa and a learning correction coefficient $\alpha$m determined by the air/fuel ratio learning system E, and controls fuel injection valves.

Figure 2:
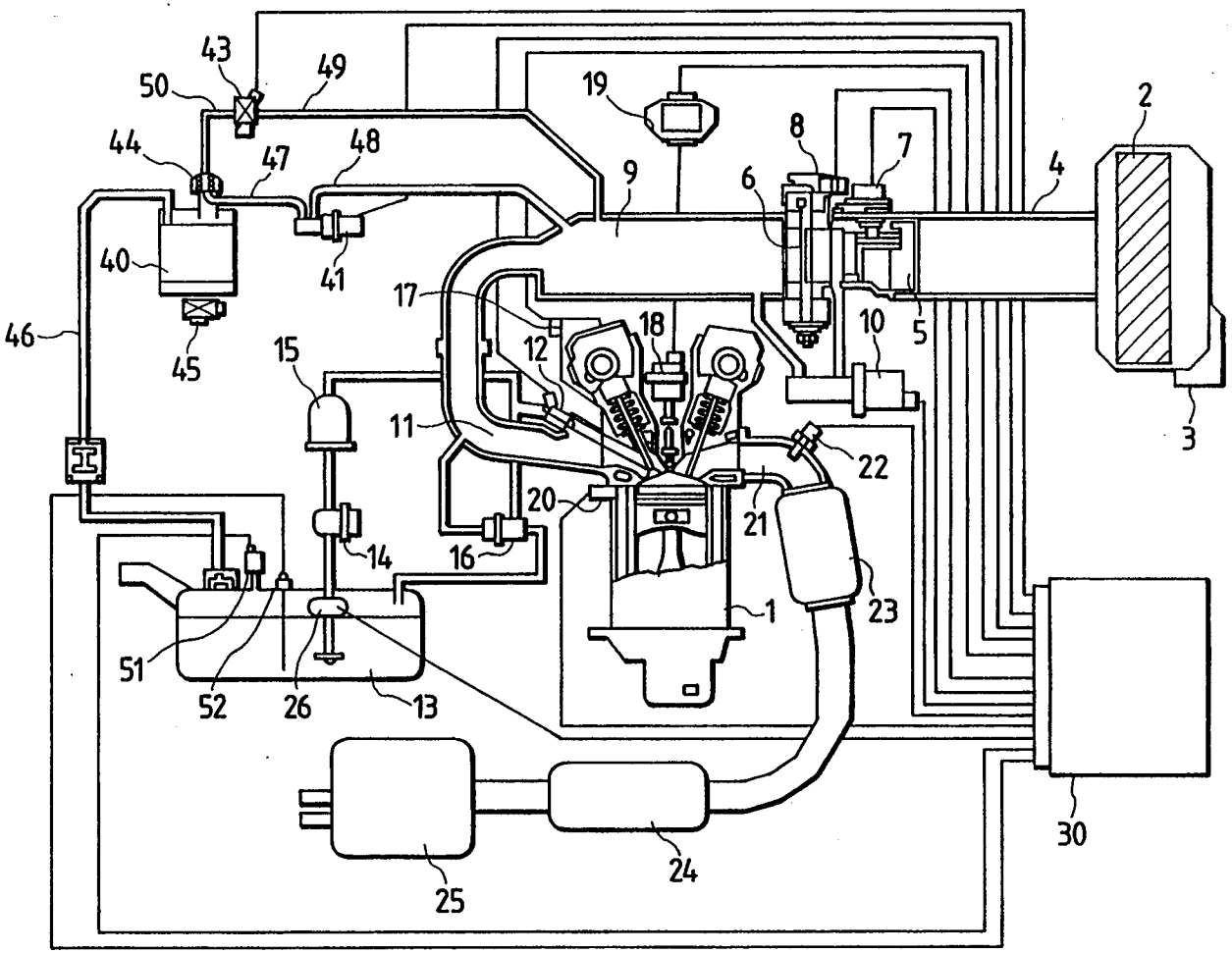
FIG. 2 is a diagram illustrating an example of an electronic control fuel injection device for an internal combustion engine to which the present invention is applied.

FIG. 2 shows an example of an electroric control fuel injection device in an internal combustion engine for a motor vehicle to which the present invention is applied, wherein numeral 1 represents an engine, 2 an air cleaner, 3 an air intake port, 4 an air intake duct, 5 a throttle body, 6 a throttle valve, 7 an air flow meter (AFM) for measuring the intake air flow rate, 8 a throttle sensor, 9 a surge tank, 10 an auxiliary air control valve (ISC valve), 11 an intake manifold, 12 a fuel injection valve (injector), 13 a fuel tank, 26 a fuel pump, 14 a fuel damper, 15 a fuel filter, 16 a fuel pressure regulating valve (pressure regulating valve), 17 a cam angle sensor, 18 an ignition coil, 19 an ignitor, 20 a water temperature sensor, 21 an exhaust gas manifold, 22 an $O_2$ sensor, 23 a pre-stage catalyst, 24 a main catalyst, 25 a muffler and 30 a control unit.

Intake air is introduced from the inlet port 3 of the air cleaner 2, passes through the air flow meter 7 which measures the intake air flow rate and through the throttle valve 6 which controls the intake air flow rate and is sent to the surge tank 9. In the surge tank 9, the intake air is divided by the intake manifold 11 which directly communicates respective cylinders of the engine 1 and is fed into the respective cylinders of the engine 1. At the same time, an output signal representing a detected intake air flow rate from the air flow meter 7 is input to the control unit 30.

On the other hand, the fuel from the fuel tank 13 is sucked and pressurized by the fuel pump 26, passes through the fuel damper 14 and through the fuel filter 15 and is supplied to the fuel injection valve 12 provided at the intake manifold 11. There, the fuel is injected depending on an injection signal from the control unit 30. At this moment, the fuel pressure acting on the fuel injection valve 12 is regulated by the fuel pressure regulating valve 16. The fuel pressure regulating valve 16 is adapted to introduce negative pressure from the intake manifold 11 and to always hold the pressure difference between the fuel pressure and the negative pressure in the intake manifold 11 at a constant value.

Further, the throttle sensor 8 which detects opening degrees of the throttle valve 6 is mounted at the throttle body 5 signals representing the opening degrees of the throttle valve 6 are input to the control unit 30. Also, the ISC valve 10 which bypasses the throttle valve 6 is mounted at the throttle body. The air flow rate bypassing the throttle valve 6 is controlled by a signal from the control unit 30 so as to maintain a constant idle speed.

Still further, reference signals for determining parameters such as engine rpm, and for controlling parameters such as fuel injection timing and ignition timing are generated by the cam angle sensor 17 and are input to the control unit 30. The temperature of the engine 1 is detected by the water temperature sensor 20 and is input to the control unit 30.

The control unit 30 calculates an optimum fuel amount, in response to the signals representing the engine conditions such as from the air flow meter 7, throttle sensor 8, cam angle sensor 17 and water temperature sensor 20. The control unit 30 drives the fuel injection valve 12 so as to feed fuel to the engine 1. The control unit 30 also calculates the ignition timing and causes to feed current to the ignitor 19 to perform ignition via the ignition coil 18.

On one hand, fuel vapor generated in the fuel tank 13 passes through a pipeline 46 and is temporarily collected at a canister 40. The collected fuel vapor together with fresh air introduced via a fresh air introducing port 45 provided at the canister 40 is introduced during engine operation into the surge tank 9 via a pipeline 47, a canister purge gas valve 41 and a pipeline 48. The fuel vapor is then fed into the engine 1 and combusted there so that exhaustion of the fuel vapor into the outside atmosphere is suppressed. Further, negative pressure introducing passages 49 and 50 are connected to a canister purge gas cut valve 44 via a purge gas cut valve 43 when the purge gas cut valve 43 is energized, negative pressure is introduced into the canister purge gas cut valve 44 to close the purge gas introduction passage.

The canister purge gas valve 41 and the purge gas cut valve 43 are provided so that the control unit 30 performs control of the purge gas flow rate to be introduced. Further, the purge gas flow rate is controlled in such a manner that a purge gas containing rate is in proportion to the intake air flow rate into the engine, thereby avoiding and adverse effect to an $O_2$ feed back control system in the electronic control fuel injection device.

Figure 3:
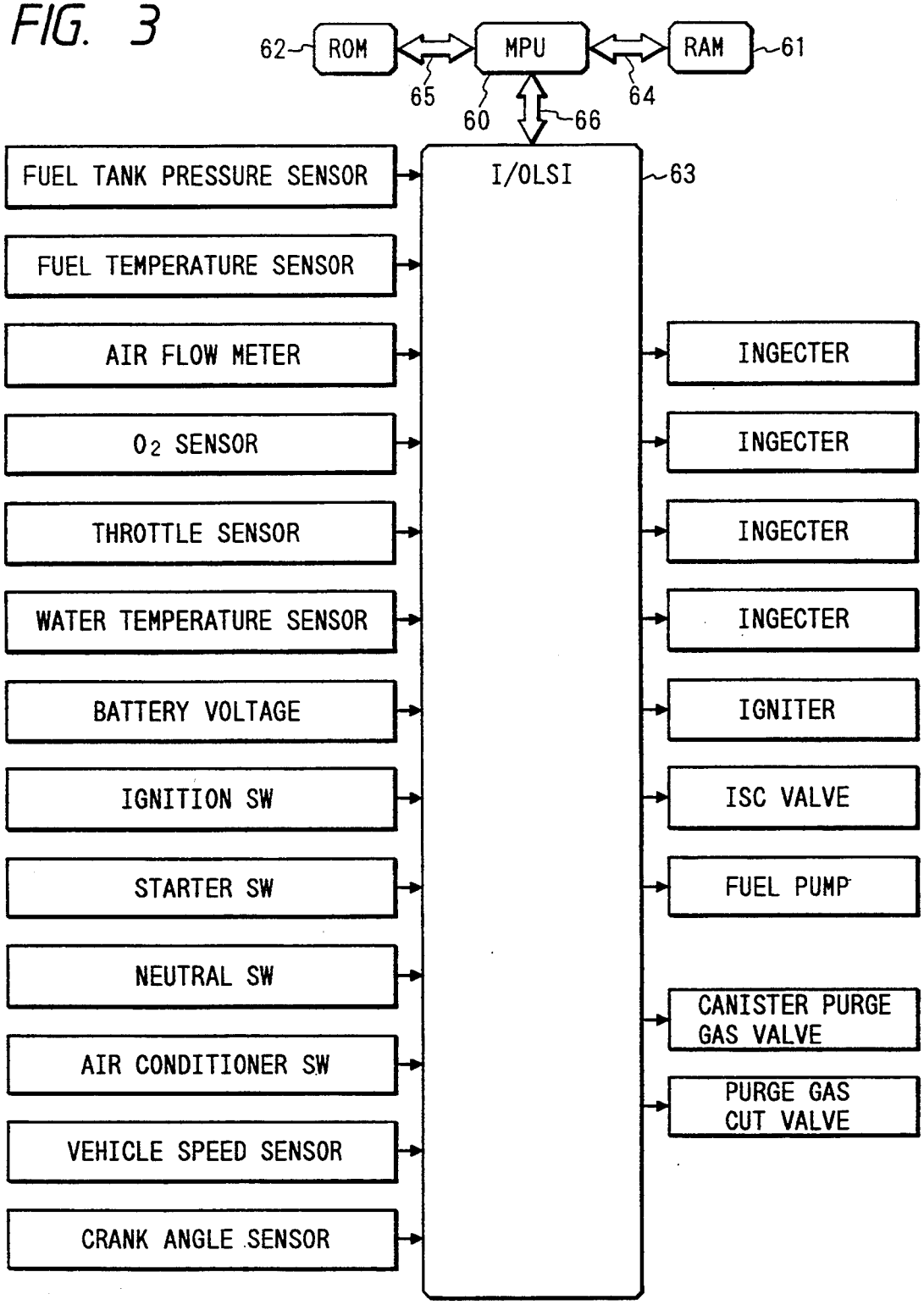
FIG. 3 is a block diagram illustrating the components of a control unit in the electronic control fuel injection device for an internal combustion engine as shown in FIG. 2.

FIG. 3 shows an internal constitution of the control unit 30 in one embodiment according to the present invention wherein an MPU 60, read/write free RAM 61, read only ROM62 and an I/O LSI 63 controlling inputs and outputs are respectively connected via buses 64, 65 and 66 so as to permit data exhange therebetween. The MPU 60 receives signals representing the engine operating condition from the I/O LSI 63 via the bus 66, sucessively retrieves contents for processing stored in the ROM 62 and performs predetermined processings. Thereafter, the MUP 62 outputs driving signals to the respective actuators such as the injector 12, ignitor 19 and auxiliary air control valve 10, again via the I/O LSI 63.

Now, a method of estimating the purge gas air/fuel ratio AFevp in the purge gas air/fuel ratio calculating systems B as shown in FIG. 1 is explained with reference to FIG. 4 through FIG. 9.

Figure 4:
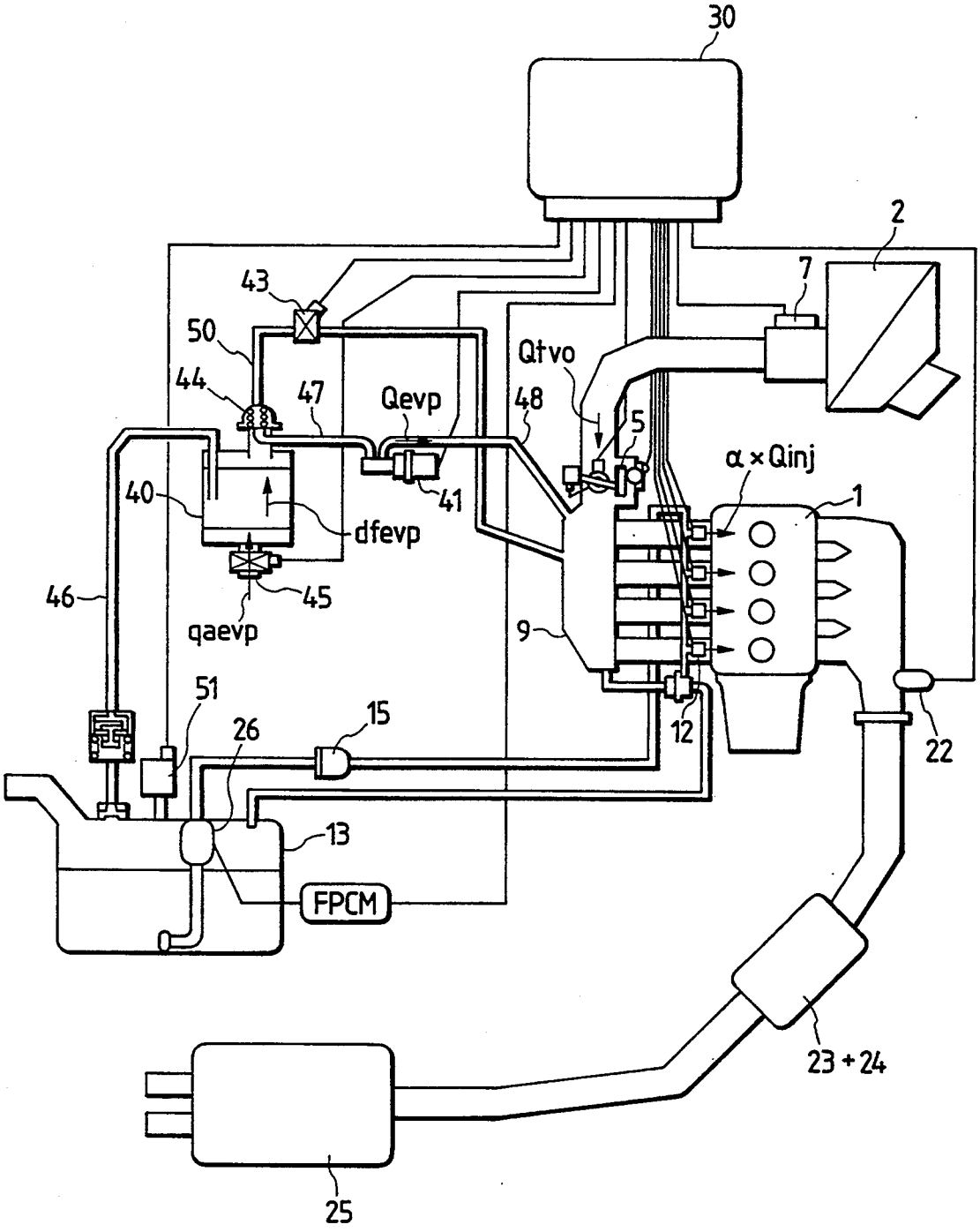
FIG. 4 is a detailed diagram of a canister purge gas control system in the electronic control fuel injection device for an internal combustion engine as shown in FIG. 2.

An air/fuel ratio of air and fuel supplied to the engine 1 is calculated based on the following equation (1);

$$AFcyl=(Qtvo+qaevp)/(\alpha\times Qinj+qfevp) \quad \ldots (1)$$

wherein the above reference symbols which are also indicated in FIG. 4 are defined as follows;

AFcyl: air/fuel ratio of air and fuel supplied to the engine 1

Qtvo: air flow rate at the throttle valve qaevp: fresh air flow rate introduced into the canister $\alpha$: $O_2$ feed back coefficient Qinj: base fuel injection amount qfevp: fuel amount removed from the canister 40

Now, an equation with regard to a required for controlling the internal combustion engine at the stoichiometric air/fuel ratio is determined which is obtained by substituting AFcyl=14.7 in equation (1);

$$a=1+Kevp\times(AFevp-14.7)/(AFevp+1) \quad \ldots (2)$$

wherein the above reference symbols a part of which is also indicated in FIG. 4 are defined as follows;

| | |
|---|---|
| Qevp : air and fuel mixture amount passing through the canister purge gas valve 41, in that<br>Qevp=qaevp + qfevp | (3) |
| Kevp : purge gas containing rate, in that<br>Kevp=Qevp/Qtvo | (4) |
| AFevp : purge gas air/fuel ratio, in that<br>AFevp=qfevp/qaevp | (5) |

As indicated in the above equation (4), the purge gas containing rate Kevp represents a ratio between the air and fuel mixture flow rate Qevp passing through the canister purge gas valve 41 and the air flow rate Qtvo passing the throttle valve passing air flow rate Qtvo and can be calculated when the respective opening degrees of the canister purge gas valve 41 and the throttle valve 6 are determined. In the present embodiment, the throttle valve opening degree is determined based on the output from the throttle sensor 8 and the canister purge gas control valve opening degree is determined based on the output value from the control unit 30. On the other hand, it is possible to calculate the purge gas air/fuel ratio AFevp according to the equation (5) however, since it is difficult to measure fuel amount qfevp being removed from the canister 40, in the present embodiment, the following equation (6) is arrived at by modifying the above equation (2) while assuming the canister removing fuel amount efevp during a steady state engine operation;

$$AFevp=(14.7\times Kevp+\alpha-1)/(Kevp+1-\alpha) \quad \ldots (6)$$

Hereinbelow the processes for determining the purge gas air/fuel ratio AFevp are explained.

Figure 5:
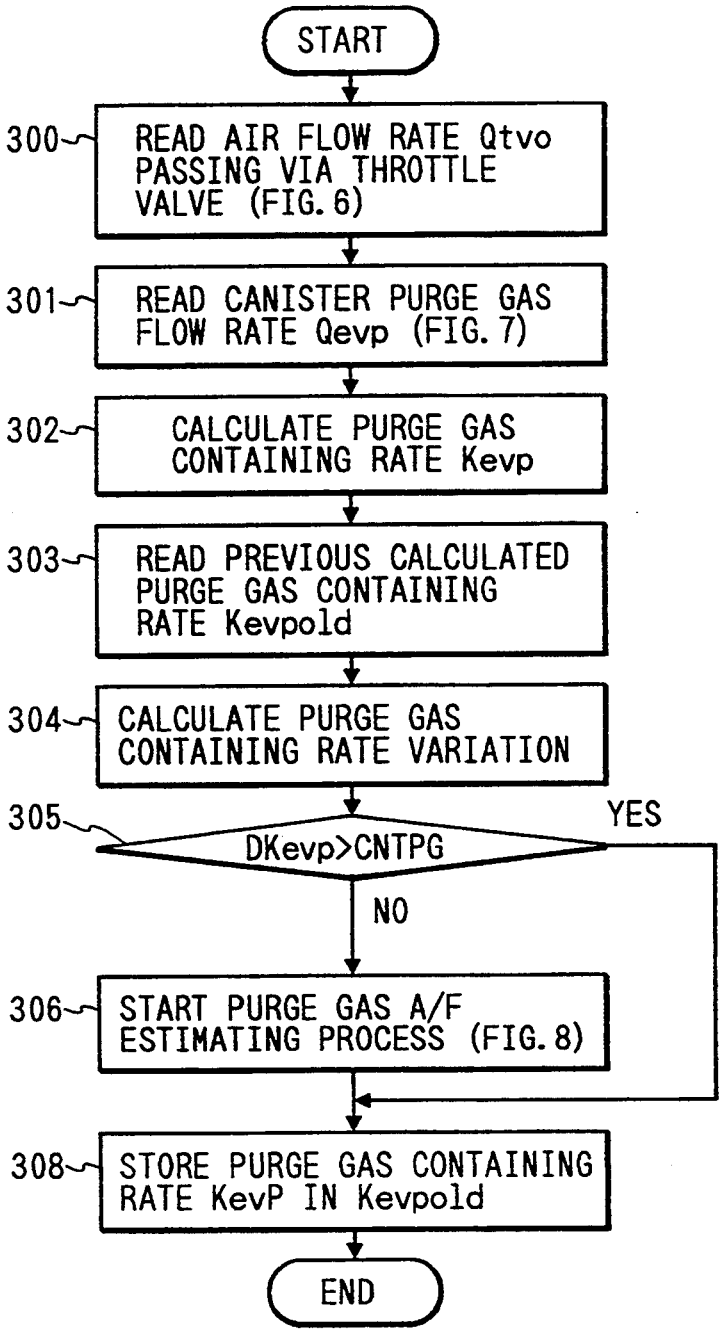
FIG. 5 is a flowchart for calculating a purge gas containing rate Kevp and a purge gas containing rate variation amount DKevp performed in the electronic control fuel injection device as shown in FIG. 2.

FIG. 5 illustrates a flowchart for determining the purge gas containing rate Kevp and purge gas containing rate variation DKevp which are performed in the purge gas containing rate calculating system C as shown in FIG. 1. At first, in step 300 the throttle valve passing air flow rate Qtvo is read and in step 301 the canister purge gas flow rate Qevp is read.

Figure 6:
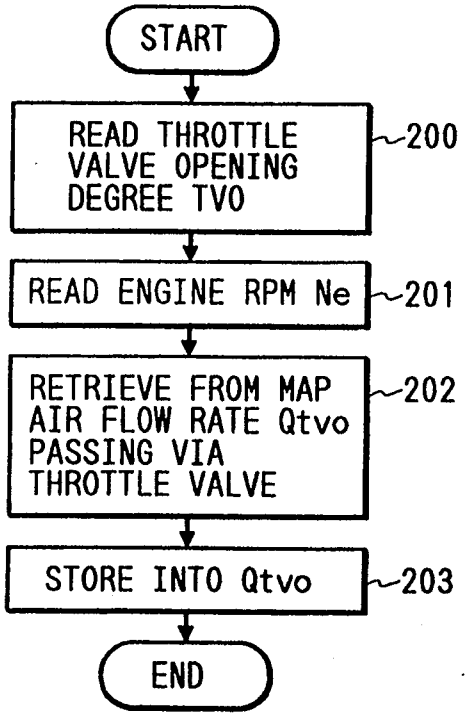
FIG. 6 is a flowchart for calculating an air flow rate Qtvo passing through a throttle valve performed in the electronic control fuel injection device for an internal combustion engine as shown in FIG. 2.

FIG. 6 illustrates a flowchart for calculating the throttle valve passing air flow rate Qtvo which is to be read in step 300 in FIG. 5. For the time being, the flowchart as illustrated in FIG. 6 is explained. At first, in step 200 the throttle valve opening degree TVO is read. Then in step 201 the engine rpm is read. Subsequently, in step 202, a throttle valve passing air flow rate Qtvo is retrieved from a throttle valve passing air flow rate map which is stored in advance in the ROM 62. The throttle valve passing air flow rate map is constituted by a matrix of engine rpm and air flow rates corresponding to throttle valve opening degree. Thereafter, in step 203 the retrieved throttle valve passing air flow rate Qtvo is stored in the RAM 61 to complete the processes in FIG. 6.

Figure 7:
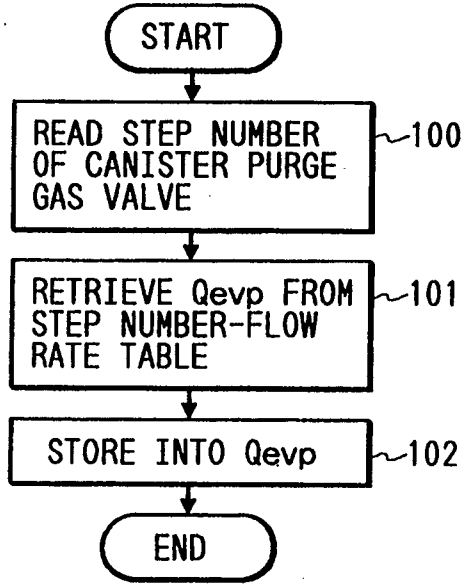
FIG. 7 is a flowchart for calculating a canister purge gas flow rate Qevp performed in the electronic control fuel injection device for an internal combustion engine as shown in FIG. 2.

FIG. 7 illustrates a flowchart for calculating the canister purge gas flow rate Qevp to be read in step 301 in FIG. 5. For the time being the flowchart as illustrated in FIG. 7 is explained. At first, in step 100 a step number representing an output value to the canister purge gas valve 41 is read in. Then, in step 101 a purge gas flow rate Qevp is retrieved from a canister purge gas valve flow rate table based on the read-in step number in step 100. The canister purge gas valve flow rate table which relates purge gas flow rate with respective step numbers is stored in advance in the ROM 62. Finally, in step 102, the retrieved purge gas flow rate Qevp is stored in a predetermined address in the RAM 61 to complete the process in FIG. 7.

Now, referring back to step 302 in FIG. 5, a purge gas containing rate Kevp is calculated based on the equation (4) using the already read-in throttle valve passing air flow rate Qtvo and purge gas flow rate Qevp. In step 303, the previously calculated purge gas containing rate Kevpold is read-in and in step 304 a purge gas containing rate variation DKevp is calculated based on the following equation (7);

$$DKevp=Kevp-Kevpold \quad \ldots (7)$$

Subsequently, in step 305, the calculated purge gas containing rate variation DKevp is compared with a predetermined value CNTPG which represents data stored in advance in the ROM 62 for judging whether or not the engine 1 is in a transient state. When it is determined in step 305 that DKevp is less than CNTPG, a purge gas air/fuel ratio estimating process is started in step 306. When it is determined that DKevp is larger than CNTPG, the process proceeds to step 308 wherein the calculated purge gas containing rate Kevp in step 302 is stored in the location of Kevpold to complete the processing.

Figure 8:
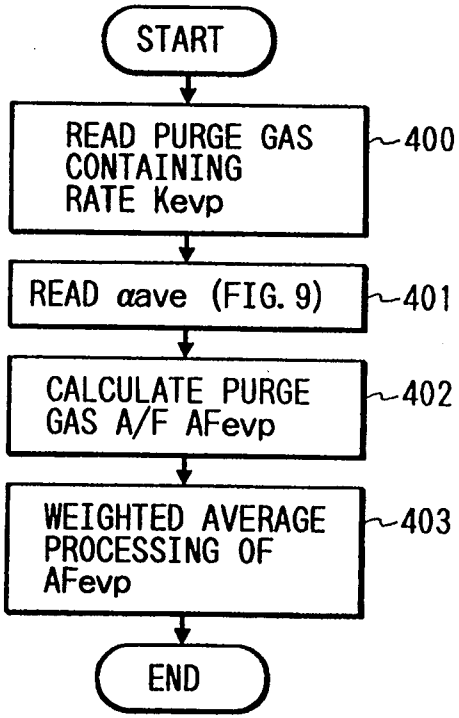
FIG. 8 is a flowchart for estimating a purge gas air/fuel ratio AFevp performed in the electronic control fuel injection device for an internal combustion engine as shown in FIG. 2.

FIG. 8 illustrates a flowchart for performing a purge gas air/fuel ratio AFevp estimating processing which is started by the step 306 in FIG. 5. At first, in step 400 a purge gas containing rate Kevp is read-in and in step 401 $\alpha$ ave is read-in. $\alpha$ ave represents an $O_2$ feedback coefficient, after being subjected to a smoothing process. The smoothed $O_2$ feedback coefficient G ave will be explained with reference to FIG. 9 later, thus the explanation thereof here is omitted. Subsequently, in step 402 a purge gas air/fuel ratio AFevp is calculated based on the equation (6). Finally, in step 403 the calculated purge gas air/fuel ratio AFevp is subjected to the following weighted averaging process to complete the instant processing.

Namely, the calculated purge gas air/fuel ratio AFevp in step 402 is moved into a register A. Then, the previously determined purge gas air/fuel ratio AFevpold is read-in into a register B. A predetermined weighted averaging rate which is stored in advance in the ROM 62 is read-in in a register C and a purge gas air/fuel ratio subjected to a weighted averaging processing is determined based on the following equation (8);

$$D=C\times A+(1-C)\times B \quad \ldots (8)$$

The content D is then stored in a location for the purge gas air/fuel ratio AFevp determined by the weighted averaging process.

Figure 9:
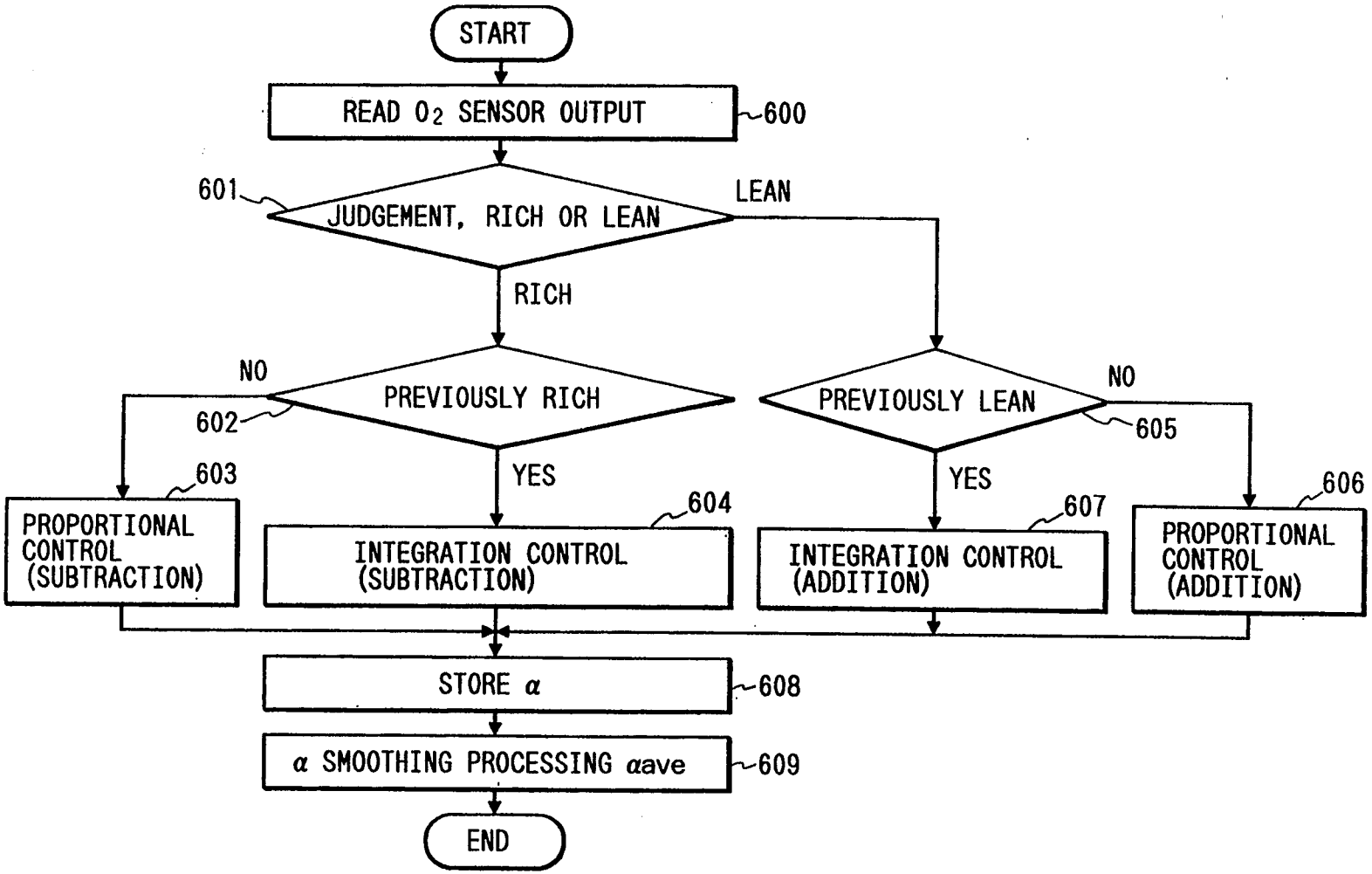
FIG. 9 is a flowchart for calculating an $O_2$ feedback coefficient $\alpha$ performed in the electronic control fuel injection device for an internal combustion engine as shown in FIG. 2.

FIG. 9 illustrates a flowchart for performing the calculation of the $O_2$ feedback coefficient $\alpha$. At first, in step 600, an output of the $O_2$ sensor is read-in. Then it is judged in step 601 whether the instant air/fuel ratio represents a fuel rich or fuel lean condition. During a fuel rich condition, the output of the $O_2$ sensor shows about 0.8 V. In contrast during a fuel lean condition the output thereof shows about 0.2 V, in that the $O_2$ sensor outputs represent like digital values. Therefore, the output value of the $O_2$ sensor is compared with a predetermined value, for example, about 0.5 V, and when the output value of the $O_2$ sensor is larger than the predetermined value it is judged that the instant air/fuel ratio represents a fuel rich condition and the process proceeds to step 602. In the case of an opposite indication, it is judged that the instant air/fuel ratio represents a fuel lean condition and the process proceeds to step 605. In step 602 the previous condition with regard to air/fuel ratio is checked and when the previous condition was a fuel lean condition which indicates that the condition is changed at the present time from a fuel lean condition to a fuel rich condition, the process proceeds to step 603 wherein a calculation for a proportional control is performed based on the following control equation (9);

$$\alpha=\alpha-ARP \quad \ldots (9)$$

wherein

ARP is a proportional correction component during a fuel rich condition which is stored in the ROM 62.

When the previous condition was a fuel rich condition in step 602, the process proceeds to step 604 wherein a calculation for an integration control is performed based on the following control equation (10);

$$\alpha=\alpha-ARI \quad \ldots (10)$$

wherein

ARI is an integration correction component during a fuel rich condition which is stored in the ROM 62.

On the other hand, when the output value of the $O_2$ sensor is smaller than the predetermined value in step 601, it is judged that the instant air/fuel ratio represents a fuel lean condition and the process proceeds to step 605. In step 605 like in step 602 the previous condition with regard to air/fuel ratio is checked and when the previous condition was a fuel rich condition which indicates that the condition is changed at the present time from a fuel rich condition to a fuel lean condition, the process proceeds to step 606 wherein a calculation for a proportional control is performed based on the following control equation (11);

$$a\alpha=\alpha+ALP \quad \ldots (11)$$

ALP is a proportional correction component during fuel lean condition which is stored in the ROM 62.

When the previous condition was a fuel lean condition in step 605, the process proceeds to step 607 wherein a calculation for an integration control is performed based on the following control equation (12);

$$\alpha=\alpha+ALI \quad \ldots (12)$$

ALI is an integration correction component during fuel lean condition which is stored in the ROM 62.

The $O_2$ feed back coefficients determined in the above processes are stored at predetermined locations in the RAM 61 in step 608.

Subsequently, in step 609 a smoothing processes for the $O_2$ feed back coefficient a is performed. In the present embodiment a weighted averaging processes is used for the smoothing process. Since the steps for the weighted averaging process are equivalent to those in step 403 in FIG. 8, the explanation thereof is omitted here.

Figure 10:
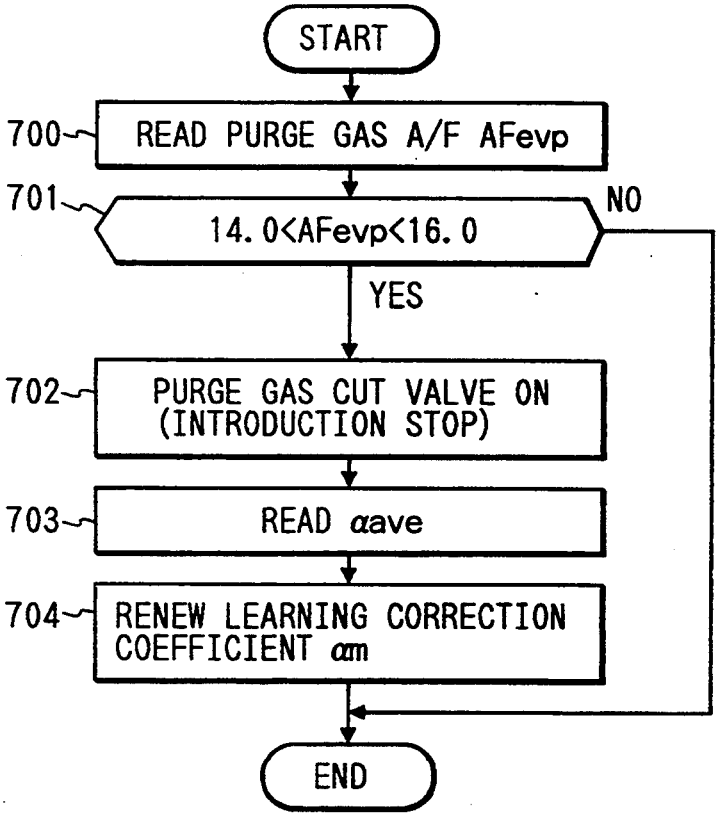
FIG. 10 is a flowchart for calculating a learning correction coefficient a m performed in the electronic control fuel injection device for an internal combustion engine as shown in FIG. 2.

FIG. 10 illustrates a flowchart for performing the calculation of a learning correction coefficient $\alpha m$ performed in the air/fuel ratio learning control system E in FIG. 1.

At first, in step 700 a purge gas air/fuel ratio AFevp is read-in. Then, the process proceeds to step 701 wherein it is checked whether the read-in purge gas air/fuel ratio AFevp is in a predetermined range. When the read-in purge gas air/fuel ratio AFevp is out of the predetermined range, the process ends. When the read-in purge gas air/fuel ratio AFevp is within the predetermined range such as between 14.0 and 16.0, the process proceeds to step 702 wherein the purge gas cut valve 43 is turned on to thereby cut the purge gas introduction. Then, the process proceeds to step 703 wherein the averaged $O_2$ feed back coefficient $\alpha$ ave is read-in. Finally, in step 704 the learning correction coefficient $\alpha m$ is renewed to complete the instant process.

Figure 11:
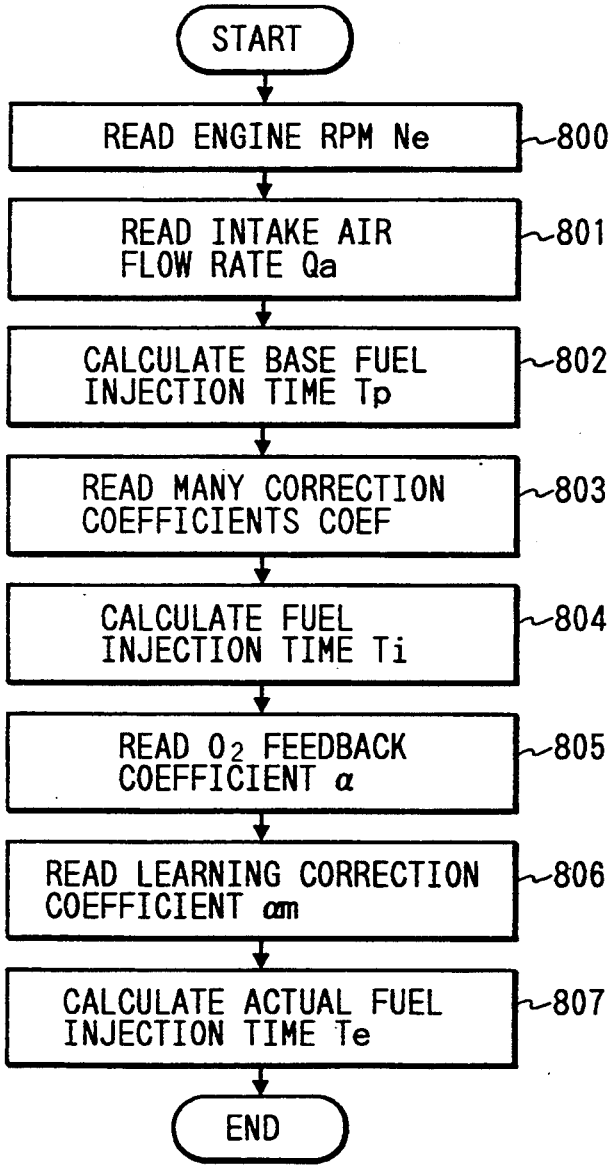
FIG. 11 is a flowchart for calculating a fuel injection time width in the electronic control fuel injection device for an internal combustion engine as shown in FIG. 2.

FIG. 11 illustrates a flowchart for performing calculation of the fuel injection time width performed in the fuel injection system F in FIG. 1. At first, in step 800, an engine rpm Ne is read-in and in step 801 an intake air flow rate Qa, which is calculated based on the output from the air flow meter 7, is read-in. In step 802 a base fuel injection time width Tp is calculated based on the following equation (13);

$$Tp=Kinj\times Qa/Ne \quad \ldots (13)$$

wherein

Kinj is an injector fuel injection amount coefficient.

Subsequently, in step 803 several kinds of correction coefficients COFF are read-in and in step 804 a fuel injection time width Ti is calculated based on the following equation (14);

$$Ti=Tp\times COFF \quad \ldots (14)$$

Then, in step 805, the corrected $O_2$ feed back coefficient $\alpha$ is read-in and in step 806 the learning correction coefficient $\alpha m$ is read-in.

Finally, an actual fuel injection time width Te is calculated based on the following equation (15) ;

$$Te=Tix(\alpha+\alpha m)+Ts \quad \ldots (15)$$

wherein

Ts is an injector invalid pulse width; and Thus, based on the resultant actual fuel injection time width, the injector is energized via the I/OLSI 63 so as to inject fuel.

According to the present invention, the purge gas air/fuel ratio is estimated and when the engine is in such an operating condition that no substantial air/fuel ratio variation is caused even when the purge gas introduction is suddenly cut, the purge gas introduction is cut and the air/fuel ratio learning control is performed, thereby an air/fuel ratio learning control is performed without causing an air/fuel ratio variation and an output power variation.

What is claimed is:

1. A fuel injection control device for an internal combustion engine, comprising:

a canister which temporarily collects fuel vapor purge gas generated in a fuel tank;

a canister purge gas control means which introduces the collected fuel vapor purge gas into the internal combustion engine during the operation thereof;

an air/fuel ratio feed back control means which controls an air/fuel ratio of air and fuel mixture introduced into the internal combustion engine by making use of an air/fuel ratio sensor; and an air/fuel ratio learning function control means which performs a learning so that an air/fuel ratio correction from said air/fuel ratio feed back control means settles at a predetermined value, wherein said canister purge gas control means includes a purge gas air/fuel ratio calculating means which determines the purge gas air/fuel ratio of the collected fuel vapor purge gas to be introduced into the combustion engine and, only during a time when the purge gas air/fuel ratio calculated by said purge gas air/fuel ratio calculating means is within a predetermined range, said canister purge gas control means interrupts the introduction of the collected fuel vapor purge gas into the internal combustion engine and said air/fuel ratio learning control means is started to perform the air/fuel ratio learning control.

2. A fuel injection control device for an internal combustion engine according to claim 1, wherein the predetermined range of the purge gas air/fuel ratio is between 14.0 and 16.0.

3. A fuel injection control device for an internal combustion engine according to claim 1, wherein when a variation of a purge gas containing rate in the air and fuel mixture introduced into the internal combustion engine exceeds a predetermined value, the calculation of the purge gas air/fuel ratio performed by said purge gas air/fuel ratio calculating means is interrupted.

4. A fuel injection control method for an internal combustion engine, comprising the steps of:

collecting temporarily fuel vapor purge gas generated in a fuel tank into a canister;

controlling introduction of the collected fuel vapor purge gas into the internal combustion engine during the operation thereof;

feed back controlling of the air/fuel ratio of air and fuel mixture introduced into the internal combustion engine by making use of an air/fuel ratio sensor;

performing air/fuel ratio learning control so that an air/fuel ratio correction performed by said feed back controlling step settles at a predetermined value;

calculating a purge gas air/fuel ratio of the collected fuel vapor purge gas to be introduced into the internal combustion engine;

interrupting the introduction of the collected fuel vapor purge gas into said internal combustion engine only during a time when the purge gas air/fuel ratio determined in said purge gas air/fuel ratio calculating step is within a predetermined range; and thereafter performing air/fuel ratio learning control of the air and fuel mixture introduced into the internal combustion engine.

5. A fuel injection control method for an internal combustion engine according to claim 4, further comprising the step of:

interrupting said purge gas air/fuel ratio calculating step when variation of a purge gas containing rate in the air and fuel mixture introduced into the internal combustion engine exceeds a predetermined value.

* * * * *